US011807918B2

(12) United States Patent
Kim et al.

(10) Patent No.: US 11,807,918 B2
(45) Date of Patent: Nov. 7, 2023

(54) ALUMINUM ALLOY FOR DIE CASTING AND METHOD FOR MANUFACTURING ALUMINUM ALLOY CASTING USING THE SAME

(71) Applicants: Hyundai Motor Company, Seoul (KR); Kia Motors Corporation, Seoul (KR); SJ TECH CO., LTD., Daegu (KR)

(72) Inventors: Byong Soo Kim, Gyeonggi-do (KR); Il Huh, Seoul (KR); Jung Mok Lee, Daegu (KR)

(73) Assignees: Hyundai Motor Company, Seoul (KR); Kia Motors Corporation, Seoul (KR); SJ Tech Co., Ltd., Daegu (KR)

( * ) Notice: Subject to any disclaimer, the term of this patent is extended or adjusted under 35 U.S.C. 154(b) by 620 days.

(21) Appl. No.: 16/172,813

(22) Filed: Oct. 28, 2018

(65) Prior Publication Data

US 2019/0316231 A1 Oct. 17, 2019

(30) Foreign Application Priority Data

Apr. 16, 2018 (KR) ..... 10-2018-0043723

(51) Int. Cl.
*C22C 21/02* (2006.01)
*B22D 21/00* (2006.01)

(52) U.S. Cl.
CPC ..... *C22C 21/02* (2013.01); *B22D 21/007* (2013.01)

(58) Field of Classification Search
None
See application file for complete search history.

(56) References Cited

U.S. PATENT DOCUMENTS

| | | | |
|---|---|---|---|
| 2,908,566 | A | 10/1959 | Cron |
| 5,571,347 | A | 11/1996 | Bergsma |
| 5,573,606 | A | 11/1996 | Evans et al. |
| 7,654,321 | B2 | 2/2010 | Zazovsky et al. |
| 9,175,372 | B2 | 11/2015 | Hori |
| 9,243,312 | B2 * | 1/2016 | Nagaishi ..... C22C 21/04 |

(Continued)

FOREIGN PATENT DOCUMENTS

| | | | |
|---|---|---|---|
| CN | 102575323 | A | 7/2012 |
| CN | 103031473 | B | 4/2013 |
| CN | 106282679 | A | 1/2017 |

(Continued)

OTHER PUBLICATIONS

Wikle, Keith G. "Improving Aluminum Castings with Beryllium". AFS Transactions, p. 513-518. (Year: 1978).*

(Continued)

*Primary Examiner* — George Wyszomierski
*Assistant Examiner* — Janell C Morillo
(74) *Attorney, Agent, or Firm* — Fox Rothschild LLP

(57) ABSTRACT

Disclosed are an aluminum alloy for a die casting and a method of producing an aluminum alloy casting product. The aluminum alloy may include silicon (Si) in an amount of about 7.5 to 9.5 wt %; magnesium (Mg) in an amount of about 2.5 to 3.5 wt %; iron (Fe) in an amount of about 0.5 to 1.0 wt %; manganese (Mn) in an amount of about 0.1 to 0.6 wt %; and aluminum (Al) constituting the remaining balance of the aluminum alloy, all the wt % are based on the total weight of the aluminum alloy.

7 Claims, 1 Drawing Sheet

(56) References Cited

U.S. PATENT DOCUMENTS

| | | | |
|---|---|---|---|
| 2016/0060731 | A1 | 3/2016 | Hwang et al. |
| 2017/0107599 | A1 | 4/2017 | Wang et al. |

FOREIGN PATENT DOCUMENTS

| | | | |
|---|---|---|---|
| CN | 110373582 | A | 10/2019 |
| CN | 110387489 | A | 10/2019 |
| EP | 0933441 | A1 | 8/1999 |
| JP | S5146549 | A | 4/1976 |
| JP | 2001335872 | A | 12/2001 |
| JP | 2011058056 | A | 3/2011 |
| JP | 2017-210653 | A | 11/2017 |
| JP | 2017210653 | A | 11/2017 |
| KR | 10-1143899 | B1 | 5/2012 |
| KR | 20130123456 | A | 11/2013 |
| KR | 10-2015-0123700 | A | 11/2015 |
| KR | 10-2017-0124963 | A | 11/2017 |
| KR | 10-2019-0120487 | A | 10/2019 |

OTHER PUBLICATIONS

Murray, G.T. et al., "Preparation and Characterization of Pure Metals", ASM Handbook vol. 2, pp. 1093-1097, ASM International, 1990.*

Wikle, Keith. (1978). Improving Aluminum Castings with Beryllium. AFS Transactions. 86. 513-518. (Year: 1978).

H. Ahlatci, "Production and corrosion behaviours of the A1—12Si—XMg alloys containing in situ Mg2Si particles", Journal of Alloys and Compounds, 503, (2010) 122-126.

Final Office Action dated Mar. 15, 2022 in U.S. Appl. No. 16/901,824.

Office Action dated Apr. 6, 2022 in corresponding Chinese Application No. 201811387763.0.

Ahlatci H. (2010) "Production and Corrosion Behaviours of the Al—12Si—XMg Alloys Containing in Situ Mg2Si Particles", Journal of Alloys and Compounds, 503(1):122-126.

Non-Final Office Action dated Jul. 28, 2022 in U.S. Appl. No. 16/901,824.

Office Action dated Jan. 31, 2023 in corresponding Korean Application No. 10-2018-0043723.

Final Office Action dated Nov. 2, 2022 in U.S. Appl. No. 16/901,824.

Y. Tan et al., "Effects of beryllium on fatigue crack propagation of A357 alloys containing iron", International Journal of Fatigue, 18(2), pp. 137-147 (1996).

J.R. Davis, "ASM Specialty Handbook—Aluminum and Aluminum Alloys—6.4.2.12 Semisolid-Metal Processing", ASM International—The Materials Information Society, pp. 88-102 (1993).

Office Action dated Aug. 4, 2023 in Chinese Application No. 202010640385.3.

* cited by examiner

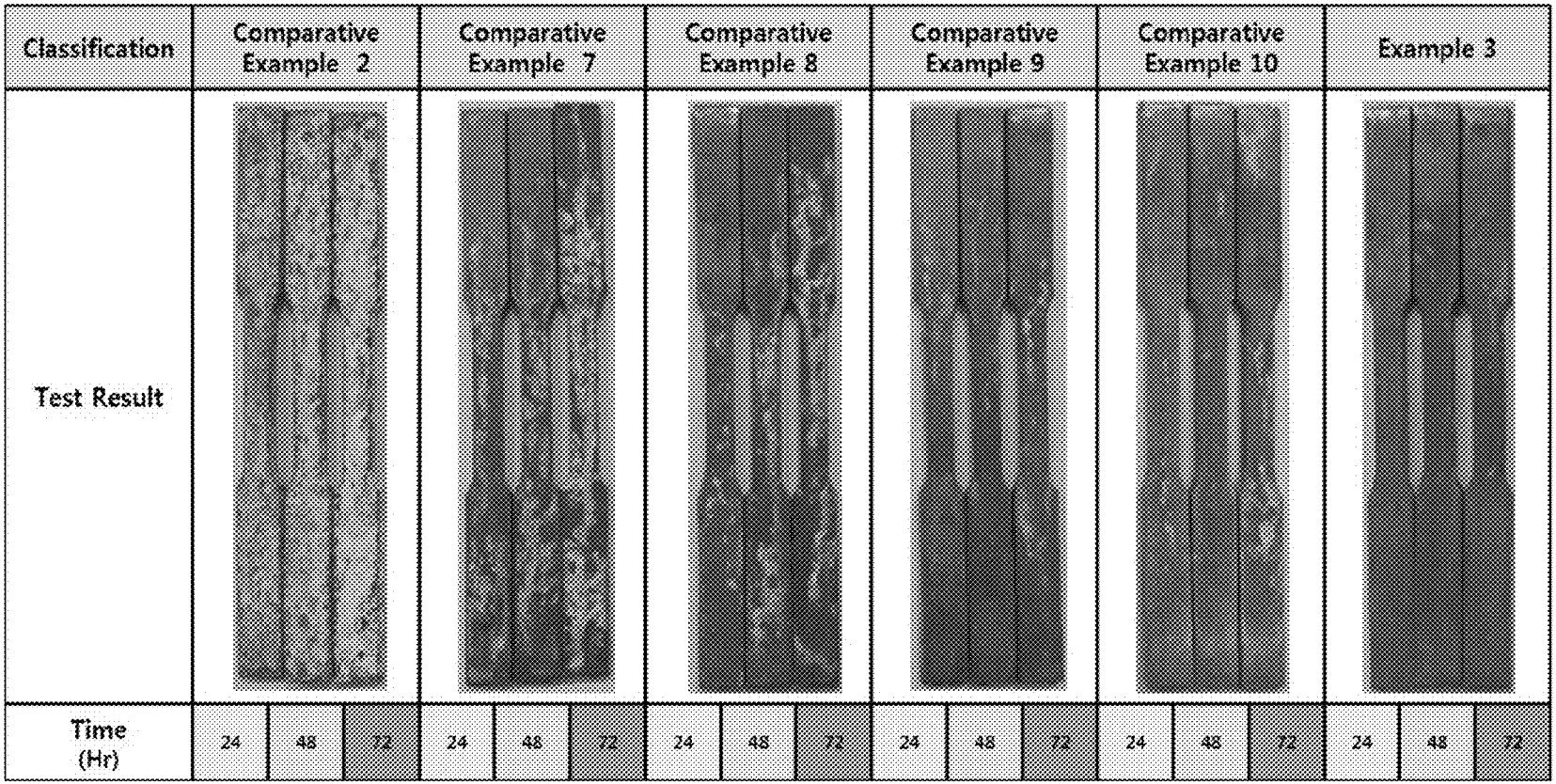
Classification
Comparative Example 2
Comparative Example 7
Comparative Example 8
Comparative Example 9
Comparative Example 10
Example 3
Test Result
Time (Hr)
24
48
72

ALUMINUM ALLOY FOR DIE CASTING AND METHOD FOR MANUFACTURING ALUMINUM ALLOY CASTING USING THE SAME

CROSS REFERENCE TO RELATED APPLICATION

The present application claims priority of Korean Patent Application No. 10-2018-0043723 filed on Apr. 16, 2018, the entire contents of which is incorporated herein for all purposes by this reference.

TECHNICAL FIELD

The present invention relates to an aluminum alloy for a die casting and a method of manufacturing an aluminum alloy casting using the same. The aluminum alloy for a die casting may have excellent thermal conductivity and corrosion resistance.

BACKGROUND OF THE INVENTION

Generally, aluminum (Al) is easy to cast, well alloyed with other metals, has strong corrosion resistance in the atmosphere, and has excellent electric and thermal conductivity, and thus aluminum has been widely used in industries.

An aluminum alloy is an alloy containing aluminum (Al) as a main component, and one or two or more of silicon (Si), copper (Su), magnesium (Mg), zinc (Zn), iron (Fe), manganese (Mn), nickel (Ni), and the like which are additionally added thereto. In addition to good plastic workability, high electric and thermal conductivity, and good appearance, physical properties of such an aluminum alloy, such as strength, heat resistance, castability and the like can be improved in accordance with various kinds of added elements.

Such aluminum alloys may be classified into alloys for an annealing and alloys for a casting. The alloy for an annealing is an alloy used in an extrusion process, a rolling process, a forging process, a press process, and the like, and the alloy for a casting is an alloy used for a sand casting mold, a cell mold, a die casting mold, and the like.

In particular, the alloy for casting may be classified into an alloy for general casing used in a sand casting mold and a cell mold, and an alloy for a diecasting used in a die casting mold. Al—Cu-based alloys, Al—Cu—Si-based alloys, Al—Si-based alloys, Al—Mg-based alloys, a heat-resistant alloy and a bearing alloy, and the like are used as the alloy for a general casting, and Al—Si-based alloys, Al—Si—Mg based alloys, Al—Mg-based alloys and Al—Si—Cu-based alloys are used as the alloy for a die casting.

For example, the Al—Si-based alloy and the Al—Mg-based alloy have been mainly used as an aluminum alloy which is industrially applied to a die casting. The Al—Si-based alloys have been used for many purposes because they have good castability, are suitable for a cast with a complicated shape, and have excellent mechanical strength at room temperature. However, when the Al—Si-based alloy includes silicon in a large amount (for example, approximately 10 wt %) for maintain good castability, thermal conductivity, which is one of the major advantages of the aluminum alloy, is not high due to addition of a large amount of silicon. It has been known that the Al—Si-based alloy has generally thermal conductivity property of about 90 to 140 W/m·K.

On the other hand, the Al—Mg-based alloy is an alloy with improved corrosion resistance, and has a disadvantage in that although it has improved corrosion resistance and thermal conductivity as compared with the Al—Si-based alloy. For example, this alloy may not be used to manufacture a product having a complicated shape because its castability is worse than that of the Al—Si-based alloy.

The foregoing as the background art is intended merely to aid in the understanding of the background of the present invention, and it should not be taken as acknowledging that the present invention falls within the purview of the related art that has been already known to those skilled in the art.

SUMMARY OF THE INVENTION

In preferred aspects, the present invention provides an aluminum alloy for a die casting and a method for manufacturing an aluminum alloy casting using the same. Accordingly, provided is an aluminum alloy with thermal conductivity and corrosion resistance as well as improved castability. Further provided is an aluminum alloy for a die casting with improved strength and elongation to enhance durability.

In one aspect, provided is an aluminum alloy for a die casting including silicon (Si) in an amount of about 7.5 to 9.5 wt %; magnesium (Mg) in an amount of about 2.5 to 3.5 wt %; iron (Fe) in an amount of about 0.5 to 1.0 wt %; manganese (Mn) in an amount of about 0.1 to 0.6 wt %; and aluminum (Al) constituting the remaining balance of the aluminum alloy. All the wt % are based on the total weight of the total weight of the aluminum alloy.

The term "aluminum alloy" as used herein refers to a material including aluminum as a main component, for example, having aluminum greater than about 90 wt %, greater than about 91 wt %, greater than about 92 wt %, greater than about 93 wt %, greater than about 94 wt %, greater than about 95 wt %, greater than about 96 wt %, greater than about 97 wt %, greater than about 98 wt %, or greater than about 99 wt %, based on the total weight of the aluminum alloy.

The aluminum alloy may further include beryllium (Be) in an amount of about 0.015 wt % or less but greater than 0 wt %.

The aluminum alloy may not include cooper (Cu), zinc (Zn), and nickel (Ni).

The aluminum alloy may suitably have thermal conductivity of about 135 W/m·K or greater.

The aluminum alloy may suitably have yield strength of about 260 MPa or greater. The aluminum alloy may suitably have tensile strength of 320 MPa or greater. The aluminum alloy may suitably have elongation of 3% or greater.

In another aspect, provided is a method for manufacturing an aluminum alloy casting product. The method may include i) preparing an molten aluminum alloy comprising silicon (Si), magnesium (Mg), iron (Fe), manganese (Mn), and aluminum (Al); injecting the molten aluminum alloy into a mold; and casting the molten aluminum alloy into the aluminum alloy casting product.

The method may further include preheating the mold to a temperature of about 200 to 250° C. before performing the injecting.

The molten aluminum alloy may include silicon (Si) in an amount of about 7.5 to 9.5 wt %; magnesium (Mg) in an amount of 2.5 to 3.5 wt %; iron (Fe) in an amount of about 0.5 to 1.0 wt %; manganese (Mn) in an amount of about 0.1 to 0.6 wt %; and aluminum (Al) constituting the remaining balance of the molten aluminum alloy. All the wt % are based on the total weight of the molten aluminum alloy.

The molten aluminum alloy may further include beryllium (Be) in an amount of about 0.015 wt % or less but greater than 0 wt %.

The molten aluminum alloy may not include cooper (Cu), zinc (Zn), and nickel (Ni).

The aluminum alloy product may have thermal conductivity of about 135 W/m·K or greater.

The aluminum alloy casting product may suitably have yield strength of 260 MPa or greater. The aluminum alloy product may suitably have tensile strength of 320 MPa or greater. The aluminum alloy product may suitably have elongation of 3% or greater.

Further provided is a vehicle comprising the aluminum alloy as described herein.

Still further provided is a die casting product comprising the aluminum alloy as described herein.

BRIEF DESCRIPTION OF THE DRAWINGS

The above and other objects, features and advantages of the present invention will be more clearly understood from the following detailed description taken in conjunction with the accompanying drawing, in which:

FIG. 1 shows a comparison of results over time after spraying salt water (NaCl 5%) to specimens in Comparative Examples and Example 3 according to an exemplary embodiment of the present invention.

DETAILED DESCRIPTION

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of the present invention will be described in detail with reference to the accompanying drawing. However, the present invention is not limited to the embodiments described below, but will be implemented in many different forms. The embodiments are provided only to complete the invention of the present invention and to fully convey the scope of the invention to those skilled in the art.

An aluminum alloy for a die casting may contain silicon (Si) in an amount of about 7.5 to 9.5 wt %: magnesium (Mg) in an amount of about 2.5 to 3.5 wt %: iron (Fe) in an amount of about 0.5 to 1.0 wt %: manganese (Mn) in an amount of about 0.1 to 0.6 wt %: and aluminum (Al) constituting the remaining balance of the aluminum alloy. All the wt % are based on the total weight of the aluminum alloy. In addition, the aluminum alloy may further include beryllium (Be) in an amount of about 0.015 wt % or less but greater than 0 wt %.

Hereinafter, the reason for restricting a composition of the alloy in the aluminum alloy for a die casting according to exemplary embodiments of the present invention will be described in detail.

Silicon (Si) in an Amount of about 7.5 to 9.5 wt %:

Silicon (Si) as used herein may improve castability and abrasion resistance and affect thermal conductivity and strength. When the content of silicon is less than about 7.5 wt %, the effect of improving castability, abrasion resistance and strength may be insignificant, and when silicon is added in the amount greater than about 9.5 wt %, properties for workability of casting, for example, machinability may be reduced and the aluminum alloy may be weakened by heat treatment. For this reason, the content of silicon may be in the range of about 7.5 to 9.5 wt %.

Magnesium (Mg) in an Amount of about 2.5 to 3.5 wt %:

Magnesium (Mg) as used herein may form $Mg_2Si$ compound, which serves as a dispersion strengthening material, together with silicon (Si) to improve strength. Further, Mg may improve corrosion resistance and elongation thereby improving machinability of casting.

At this time, when the content of magnesium (Mg) is less than about 2.5 wt %, an improving effect of corrosion resistance, elongation and strength is insignificant, and when the content of magnesium is greater than about 3.5 wt %, the flowability of melt may be reduced during a casting, an oxidation tendency of the melt may also be increased to increase dross. For this reason, the content of magnesium may be in the range of about 2.5 to 3.5 wt %.

Iron (Fe) in an Amount of about 0.5 to 1.0 wt %:

Iron (Fe) as used herein may contribute to forming solid solution strengthening and dispersion strengthening. When the content of iron is less than about 0.5 wt %, the effect of improving strength may be insignificant, and when the content of iron is greater than about 1.0 wt %, there is a drawback that thermal conductivity and castability are degraded. For this reason, the content of iron (Fe) may be in the range of about 0.5 to 1.0 wt %.

Manganese (Mn) in an Amount of about 0.1 to 0.6 wt %:

Manganese (Mn) as used herein may, together with iron (Fe), contribute to forming solid solution and improving strength of casting. However, as the content manganese is increased, castability and machinability may be reduced and thermal conductivity may be decreased. For this reason, the content of manganese may be in the range of about 0.1 to 0.6 wt %.

Beryllium (be) in an Amount of about 0.015 wt % or Less but Greater than 0 wt %:

Beryllium (Be) as used herein may prevent an oxidation of magnesium (Mg) to inhibit a formation of dross during a casting process and improve corrosion resistance. However, when beryllium is added in the amount greater than about 0.015 wt %, corrosion resistance of the aluminum alloy may deteriorate, and thus the content of beryllium may be less than about 0.015 wt %. The content of beryllium (Be) may suitably be in the range of about 0.002 to 0.015 wt %.

Preferably, the aluminum alloy may not include copper (Cu), zinc (Zn), and nickel (Ni), which may cause corrosion of the aluminum alloy. Accordingly, corrosion resistance of the casting to be manufactured may be enhanced to minimize an occurrence of corrosion.

A method for manufacturing an aluminum alloy casting product may include a preparing process of preparing molten aluminum alloy having the above-described composition, a casting process of injecting the prepared molten aluminum alloy into a mold, and a casting process of casting the molten aluminum alloy into the aluminum alloy casting product.

At this time, the method may further include a preheating process of preheating a mold to a temperature of about 200 to 250° C. before the casting process.

For example, the mold may be preheated to sufficiently high temperature of about 200 to 250° C. to prevent cracks and casting defects from being generated when the molten aluminum alloy prepared as above described is casted to produce the aluminum alloy casting.

Here, when the mold is preheated to a temperature of less than about 200° C., a preheating effect of the mold may not be insignificant, and further filling ability in the mold may be also reduced due to deterioration of the fluidity of the molten aluminum alloy, thereby causing casting defects. In addition, when the mold is preheated to a temperature greater than about 250° C., a preheating cost may be increased, crystal grain coarsening of the aluminum alloy castings to be produced later may be caused or a crack may be caused during a cooling process. For this reason, the preheating temperature for the mold may be in the range of about. Preferably, in the casting step, molten aluminum alloy prepared as described above may be casted into the preheated mold under a pressure of about 75 MPa.

EXAMPLE

Hereinafter, examples of the present invention will be described in detail. However, the following examples are merely illustrative of the present invention, and the present invention is not limited to the following examples.

Composition of various Examples of the present invention and Comparative Examples are as shown in Table 1 below.

TABLE 1

| Classification | Al | Si | Mg | Fe | Mn | Be | Cu | Zn | Ni | Sn | Pb | Ti |
|---|---|---|---|---|---|---|---|---|---|---|---|---|
| Example 1 | rem. | 7.5 | 2.5 | 0.5 | 0.1 | — | — | — | — | — | — | — |
| Example 2 | rem. | 8.0 | 3.5 | 0.7 | 0.3 | — | — | — | — | — | — | — |
| Example 3 | rem. | 8.0 | 3.0 | 0.7 | 0.3 | 0.005 | — | — | — | — | — | — |
| Comparative Example 1 (ALDC5) | rem. | 0.2 | 6.0 | 0.8 | 0.1 | — | 0.1 | 0.05 | 0.05 | 0.05 | 0.05 | 0.1 |
| Comparative Example 2 (ALDC12) | rem. | 12 | 0.2 | 0.8 | 0.1 | — | 3.0 | 0.7 | 0.3 | 0.1 | 0.1 | 0.1 |
| Comparative Example 3 | rem. | 5.32 | 2.73 | 0.49 | 0.14 | — | — | — | — | — | — | — |
| Comparative Example 4 | rem. | 5.42 | 2.81 | 0.51 | 0.14 | — | — | — | — | — | — | — |
| Comparative Example 5 | rem. | 12.45 | 2.84 | 0.50 | 0.14 | — | — | — | — | — | — | — |
| Comparative Example 6 | rem. | 12.43 | 2.85 | 0.52 | 0.14 | — | — | — | — | — | — | — |
| Comparative Example 7 | rem. | 8.32 | 1.73 | 0.49 | 0.14 | — | — | — | — | — | — | — |
| Comparative Example 8 | rem. | 8.42 | 1.71 | 0.51 | 0.14 | — | — | — | — | — | — | — |
| Comparative Example 9 | rem. | 8.45 | 4.54 | 0.50 | 0.14 | — | — | — | — | — | — | — |
| Comparative Example 10 | rem. | 8.43 | 4.55 | 0.52 | 0.14 | — | — | — | — | — | — | — |

At this time, Comparative Examples 1 and 2 were conventional aluminum alloys for a die casting, Comparative Example was ALDC5, which is one of Al—Mg-based alloys, and Comparative Example 2 was ALDC12, which is one of commercially available Al—Si-based alloys.

ASTM SUBSIZE test specimens (a gauge length (G) of 25 mm; a width of 6.25 mm; a thickness (T) of 3.05 mm; a radius of fillet (R) of 6.0 mm; a longitudinal length (L) of 100 mm or more; a length of parallel section (A) of 32 mm; a width of grip section (C) of 10 mm) for Examples and Comparative Examples in Table 1 were manufactured and a tensile test (KS B 0802) was carried out for the above test specimens, and a test specimen of 10 mm×10 mm×2t was manufactured and a test for measuring thermal conductivity (ASTM E 1461) was carried out for the test specimen to measure the physical properties for each of Examples and Comparative Examples. Measurement values physical properties are shown in below Table 2.

TABLE 2

| Classification | Thermal conductivity (W/m · K) | Tensile strength (MPa) | Yield strength (MPa) | Elongation (%) |
|---|---|---|---|---|
| Example 1 | 150 | 320 | 260 | 4.0 |
| Example 2 | 135 | 350 | 285 | 3.0 |
| Example 3 | 140 | 330 | 280 | 3.0 |
| Comparative Example 1 | 96 | 280 | 180 | 2.0 |
| Comparative Example 2 | 96 | 300 | 150 | 3.0 |
| Comparative Example 3 | 148 | 321 | 198 | 6.5 |
| Comparative Example 4 | 135 | 325 | 197 | 6.8 |

TABLE 2-continued

| Classification | Thermal conductivity (W/m · K) | Tensile strength (MPa) | Yield strength (MPa) | Elongation (%) |
|---|---|---|---|---|
| Comparative Example 5 | 102 | 317 | 254 | 5.3 |
| Comparative Example 6 | 103 | 345 | 251 | 3.0 |

As shown in Tables 1 and 2, according to Examples of the present invention, the aluminum alloy for a die casting can be manufactured to have excellent physical properties including thermal conductivity of 135 W/m·K or greater, yield strength of 260 MPa or more, tensile strength of 320 MPa or more, and elongation of 3% or more.

In particular, as compared with the conventional aluminum alloys for a die casting, it can be found that, in the aluminum alloys of the present invention, not only the thermal conductivity was improved by greater than 40% but also the tensile strength was improved by greater than 6%, the yield strength was improved by greater than 44%, and the elongation was secured at the same folds or greater. Accordingly, a casting product having excellent durability as compared with a conventional casting may be manufactured.

In particular, as shown in Examples 1 to 3 of the present invention and Comparative Examples 3 to 6, when the content of silicon (Si) in the present invention was less than 7.5 wt %, formation of $Mg_2Si$ compound was insignificant to cause a lowering of the yield strength, and when the content of silicon (Si) was greater than 9.5 wt %, the thermal conductivity was rapidly reduced due to an increase of alloying elements. For this reason, it is preferable to limit the content of silicon to the range of about 7.5 wt % to 9.5 wt %.

Accordingly, when electric parts for vehicle are manufactured using the aluminum alloy according to the embodiment of the present invention, since as compared a conventional aluminum alloy, the aluminum alloy of the present invention may have excellent thermal conductivity and improve heat dissipation performance, the present invention may provide an advantage that it is possible to enhance performance and lifetime of the product.

FIG. 1 is a photograph showing Comparative Examples and Example at 24 hours, 48 hours, and 72 hours after salt water (NaCl 5%) was sprayed to Comparative Example 2 and 7 to 10 and Example 3 according to exemplary embodiments of the present invention.

At this time, a salt water spray test (KS D 9502) was carried out using salt water of NaCl 5% after preparing ASTM SUBSIZE test specimen.

It can be found from FIG. 1 that although corrosion was significantly proceeded on Comparative Example 2 (ALDC12) which is one of the commercial available Al—Si-based alloys after 24 hours from the spraying of salt water, even after 48 hours have elapsed, Example 3 of the present invention was maintained in an initial state in which corrosion hardly occurs.

In particular, as shown in Comparative Examples 7 to 10, when the content of magnesium (Mg) was less than 2.5 wt %, corrosion resistance was remarkably deteriorated to cause considerable corrosion, and when the content of magnesium (Mg) was greater than 3.5 wt %, corrosion resistance was reduced again to cause corrosion.

Therefore, when vehicle electric parts which may be left for a long time under the external environment such as high temperature and high humidity condition, seawater, rain water, and the like are manufactured by using the aluminum alloy according to various exemplary embodiments of the present invention, the life time and durability of manufactured electric parts of a vehicle may be enhanced and manufacturing cost may be reduced because no separate anti-rust treatment is required.

According to various exemplary embodiments of the present invention, a variety of castings may be manufactured, which are required to have excellent thermal conductivity and corrosion resistance, by improving thermal conductivity and corrosion resistance compared to a conventional aluminum alloy for a die casting, while securing castability.

As compared with a conventional aluminum alloy for a die casting, in addition, the aluminum ally according to the present invention may be excellent in strength and elongation, and thus a casting product having excellent durability may be produced.

Although the present invention has been described with reference to the accompanying drawings and the preferred embodiments described above, the present invention is not limited thereto, but is limited by the following claims. Accordingly, those skilled in the art may modify and change variously the present invention without departing from the technical spirit of the following claims.

What is claimed is:

1. An aluminum alloy for a die casting, consisting of,
silicon (Si) in an amount of 7.5 to 9.5 wt %;
magnesium (Mg) in an amount of 2.5 to 3.5 wt %;
iron (Fe) in an amount of 0.7 to 1.0 wt %;
manganese (Mn) in an amount of 0.1 to 0.6 wt %;
inevitable impurities, and
aluminum (Al) constituting the remaining balance of the aluminum alloy,
all the wt % based on the total weight of the aluminum alloy.

2. The aluminum alloy of claim 1, wherein the aluminum alloy has thermal conductivity of about 135 W/m·K or greater.

3. The aluminum alloy of claim 1, wherein the aluminum alloy has yield strength of about 260 MPa or greater.

4. The aluminum alloy of claim 1, wherein the aluminum alloy has tensile strength of about 320 MPa or greater.

5. The aluminum alloy of claim 1, wherein the aluminum alloy has elongation of 3% or greater.

6. A vehicle comprising an aluminum alloy of claim 1.

7. A die casting product comprising an aluminum alloy of claim 1.

* * * * *